US011629582B2

(12) United States Patent
Arribau

(10) Patent No.: US 11,629,582 B2
(45) Date of Patent: Apr. 18, 2023

(54) LIQUID PLUNGER METHOD AND APPARATUS

(71) Applicant: Colina, Englewood, CO (US)

(72) Inventor: Jorge O. Arribau, Englewood, CO (US)

( * ) Notice: Subject to any disclaimer, the term of this patent is extended or adjusted under 35 U.S.C. 154(b) by 324 days.

(21) Appl. No.: 17/002,519

(22) Filed: Aug. 25, 2020

(65) Prior Publication Data

US 2022/0065087 A1 Mar. 3, 2022

(51) Int. Cl.

| | |
|---|---|
| ***E21B 43/26*** | (2006.01) |
| ***E21B 34/00*** | (2006.01) |
| ***B01F 23/50*** | (2022.01) |
| ***B01F 33/502*** | (2022.01) |
| ***B01F 101/49*** | (2022.01) |

(52) U.S. Cl.

CPC ..... *E21B 43/2607* (2020.05); *B01F 23/50* (2022.01); *B01F 33/5021* (2022.01); *E21B 34/00* (2013.01); *B01F 23/565* (2022.01); *B01F 2101/49* (2022.01)

(58) Field of Classification Search

CPC .... E21B 43/2607; E21B 34/00; E21B 21/062; B01F 23/50; B01F 23/565; B01F 2101/49

See application file for complete search history.

(56) References Cited

U.S. PATENT DOCUMENTS

| | | | | |
|---|---|---|---|---|
| 7,201,557 | B2 * | 4/2007 | Stover | F04F 13/00 417/103 |
| 8,127,844 | B2 * | 3/2012 | Luharuka | E21B 21/062 166/275 |
| 8,678,514 | B2 * | 3/2014 | Efthymiou | E02F 7/065 299/8 |
| 9,133,701 | B2 | 9/2015 | Luharuka et al. | |
| 9,291,038 | B2 * | 3/2016 | Dotson | E21B 43/114 |
| 9,790,775 | B2 | 10/2017 | Joseph et al. | |
| 10,465,717 | B2 * | 11/2019 | Hoffman | F04F 13/00 |
| 10,767,457 | B2 * | 9/2020 | Ghasripoor | E21B 43/16 |
| 10,837,465 | B2 * | 11/2020 | Oklejas, Jr. | F04F 13/00 |
| 10,920,555 | B2 * | 2/2021 | Procita | F24F 13/00 |
| 11,320,079 | B2 * | 5/2022 | Kuhn De Chizelle | F16L 41/03 |
| 11,326,430 | B2 * | 5/2022 | Ghasripoor | E21B 43/26 |
| 11,428,058 | B2 * | 8/2022 | Haiderer | E21B 43/2607 |
| 2004/0218464 | A1 * | 11/2004 | Arribau | B01F 33/502 366/264 |
| 2007/0175916 | A1 * | 8/2007 | Oldham | G01F 11/086 222/1 |
| 2010/0243251 | A1 | 9/2010 | Luharuka et al. | |
| 2018/0030968 | A1 * | 2/2018 | Verma | F04F 13/00 |
| 2020/0063545 | A1 * | 2/2020 | Shampine | E21B 43/261 |
| 2020/0149380 | A1 * | 5/2020 | Procita | F24F 13/00 |

FOREIGN PATENT DOCUMENTS

CA 2696248 C * 9/2010

* cited by examiner

*Primary Examiner* — Jonathan Malikasim
(74) *Attorney, Agent, or Firm* — Reilly Intellectual Property Law Firm

(57) ABSTRACT

A dual chamber assembly for continuously injecting slurry into a wellhead by displacing it from chambers with pressurized clean fluid.

22 Claims, 7 Drawing Sheets

LIQUID PLUNGER METHOD AND APPARATUS

The current assembly relates to pressurizing slurry for oil and gas extraction operations; and more particularly relates to a novel and improved apparatus and method for pressurizing and displacing liquid with solid particles which is conformable for use with blenders, fixed displacement and centrifugal pumps.

BACKGROUND AND FIELD

A hydraulic fracturing ("frac") job consists of the delivery of great quantities of a fluid (water or oil based) into a well at pressures of up to 20,000 psi in order to fracture the reservoir rock, thus creating draining channels for the oil and or gas trapped in the formation to flow to the wellbore. In order to keep the draining channels open once the well is opened to allow the oil or gas to flow, a proppant such as sand, ceramics, bauxite, or others is added to the fluid injected in the well. The sand concentration of the fluid can vary from ½ lb. per gallon to 21 lbs. per gallon. It is not unusual for a frac job to inject 5,000,000 gals. of water and 15,000,000 lbs. of sand. In order to perform a frac job, large sand and water storage tanks are connected to a blender unit. The blender draws the fluid from the tanks and the sand from the storage bins through conveyor belts. As the blender mixes the water and sand, it may also add other chemicals, and delivers this mixture to the fixed displacement plunger pumps (frac pumps), at pressures between 50 and 120 psi, to be injected in the well at whatever pressure and rate is required to fracture the formation; anywhere between 3,000 and 20,000 psi.

The pumping of such a high volume of sand and water slurry results in a rapid wearing of pump valves, seats, fluid ends, packing and plungers and this is the most expensive aspect of any frac job. Without including the labor required to replace failed components during operations, the cost to maintain a frac pump may be as high as $300,000 per year on fluid ends, plungers, seats and valves replacements due to sand or other proppants erosion. Furthermore, due to these failures additional units must be dispatched to the job location as back-up for the units that must be taken off the line for repairs. As a result, substantial savings in operating expenses and capital equipment are to be had if sand is not introduced into the frac pumps.

There is a continuing but unmet need for an apparatus that can pressurize slurry while maintaining the integrity of the mechanical components during operation.

SUMMARY

This apparatus is comprised of at least two identical high-pressure cylinders, capped with high pressure flanges, placed vertically, or at an angle no lower than 30 degrees from the horizontal, between the blender and the frac pumps. These two vessels will receive the slurry from the blender to be later pressurized by the frac pumps without the slurry ever reaching the valves and seats of the frac pumps. Each chamber has two, 3-inch or greater, connections at the bottom to use as inlet and outlet. One inlet at the bottom is connected to the blender and the other bottom outlet to the wellhead. At the top of the chambers, there are two, 3-inch or greater, connections wherein each of the lines coming from the top goes through a directional valve. One of the lines has a flowmeter located between its valve and the intake of the frac pump or pumps. This line and flowmeter will be exposed to the discharge pressure of the blender (between 50 and 120 psi). The other top line is piped to the high-pressure discharge of the same pump or pumps and will be exposed to pressures up to 15,000 psi and possibly higher. The directional valves can be either rotating or sliding. The two valves are set to be in opposite positions so that is one open and the other one is closed. These two valves are also mechanically connected in order to be certain that they both move together.

The directional valves on the lines connected to the top of each vessel are further mechanically connected to an actuator to ensure that all four valves move simultaneously. A logic control unit will read the low-pressure volume exiting the vessel being filled with slurry and at a preset volume it will operate the valves actuator and reverse the high-pressure flow to the other vessel and its slurry intake. The opposite will occur in the other vessel. The two chambers, if placed between the fixed displacement pumps and the discharge point of the slurry, will keep the abrasive solids away from the fixed displacement pumps. This will result in savings on valves and fluid ends in hydraulic fracturing operations due to less wear and tear on the equipment and may also be useful in other slurry pumping operations such as disposal of contaminants as well as dangerous and radioactive fluids.

There is provided an apparatus for pressurizing solid particles and fluid using a blender and frac pumps for discharge into a wellhead, comprising at least one pair of synchronized pressure chambers, each of first and second chambers adapted for vertical or relatively horizontal orientation, at least two inlet lines secured at a first end of each of the first and second chambers and to the blender, at least two high-pressure outlet lines secured at the first end of each of the chambers and in fluid communication with the wellhead, at least two outlet lines secured to a second end of each of the chambers and to the frac pumps, at least two high-pressure inlet lines secured to the second end of each of the chambers and to the frac pumps, first valve members operatively connected to the inlet lines and the high-pressure outlet lines proximal to the first end of each of the chambers, second valve members operatively connected to the outlet lines and the high-pressure inlet lines proximal to the second end of each of the chambers, and flow meters mechanically connected to each of the outlet lines and operatively connected to a logic control unit including at least one valve actuator.

There is also provided a method of pressurizing and discharging slurry into a wellhead, by first filling both chambers and frac pumps with clean fluid, the following simultaneous steps comprising the blender injecting slurry into a first chamber displacing its clean fluid, the frac pumps receiving the volume of clean fluid displaced and injecting it at high pressure into a second chamber in a synchronous operation displacing the volume of the second vessel into the wellhead. Once the entire volume of clean fluid of the first vessel has been displaced by slurry the actuator will reverse the directional valves forcing slurry into the second vessel displacing clean fluid into the frac pumps to inject the slurry of the first vessel into a wellhead. This system proposes the addition of two high pressure chambers to be placed vertically between the blender and the frac pumps to receive the slurry from the blender and to allow the frac pumps to pressurize it without the sand laden fluid ever reaching the valves and seats of the frac pumps.

It is therefore an object to provide for a novel method and apparatus for blending liquids and solid particles by counterflow of the liquid to prevent contact with the frac pumps and seats. In addition to the method and articles of manufacture described above, further aspects and embodiments will become apparent by reference to the drawings and by study of the following descriptions. Exemplary embodiments are illustrated in reference to Figures of the drawings. It is intended that the embodiments and Figures disclosed herein are to be considered illustrative rather than limiting.

DETAILED DESCRIPTION

Figure 4:
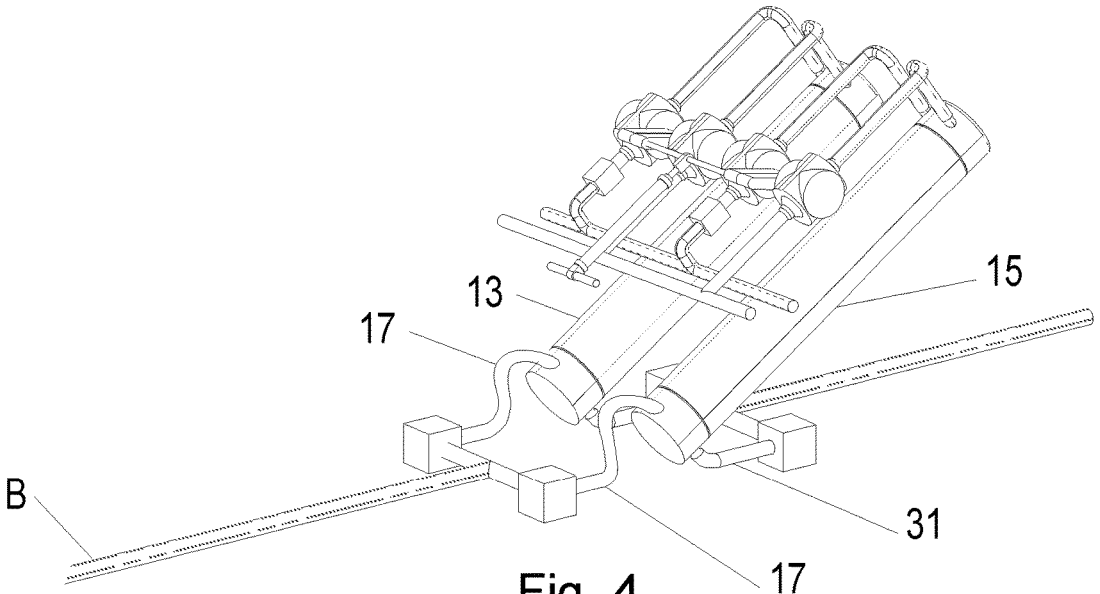
FIG. 4 is a perspective view of an alternate orientation of the assembly shown in FIG. 1.

Referring in more detail to FIGS. 1-9 of the drawings, in oil and gas operations, such as, fracturing, the unit or assembly 11 is mounted on a truck bed T including a blender B for mixing solid particulate matter, such as, sand to be thoroughly mixed with a liquid which is then introduced through a low pressure slurry line to the unit for pressurization and eventual delivery to a well head. While the apparatus is described and shown as being truck-mounted, it will be appreciated that it can be mounted on a fixed support and be oriented vertically or canted at an angle as shown in FIG. 4. The assembly 11 comprises at least two chambers 13 and 15 capable of withstanding high pressures to be placed vertically, or at an angle no lower than 30 degrees from the ground, between the blender unit B and frac pumps P. The chambers 13 and 15 are adapted to withstand at least 15,000 psi of working pressure and are preferably fabricated of large diameter seamless tubing such as steel tubing or hollow helical strand (HHS) tubing of approximately 20 inches in diameter with a preferable wall thickness of 1.417 and a height of approximately 100.1 inches having first or upper ends 12, 14 and second or lower ends 27, 29 that seal the chambers 13 and 15. The upper and lower ends 12, 14 and 27, 29 include high pressure flanges 16 and stub ends or caps 18 for sealing opposite ends of the chambers.

Figure 1:
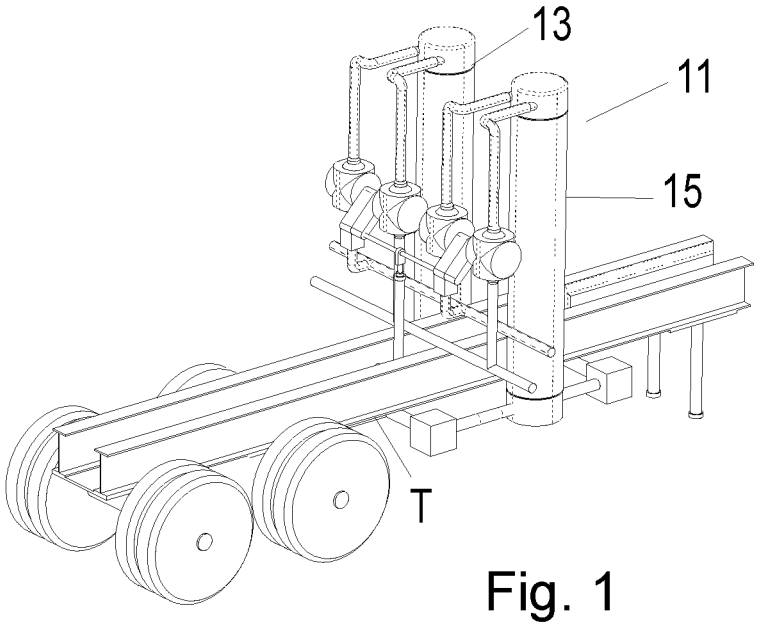
FIG. 1 is a side perspective view of a form of liquid plunger assembly mounted on a truck.
Figure 2:
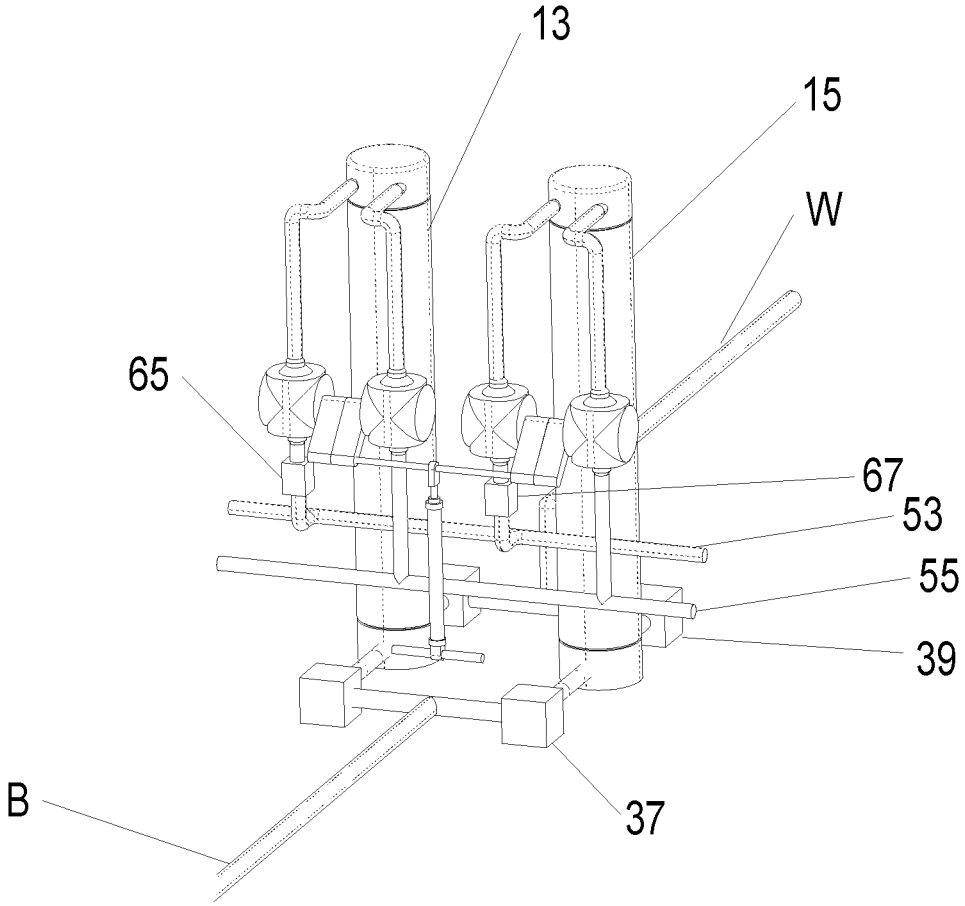
FIG. 2 is a front perspective view of the assembly shown in FIG. 1.
Figure 3:
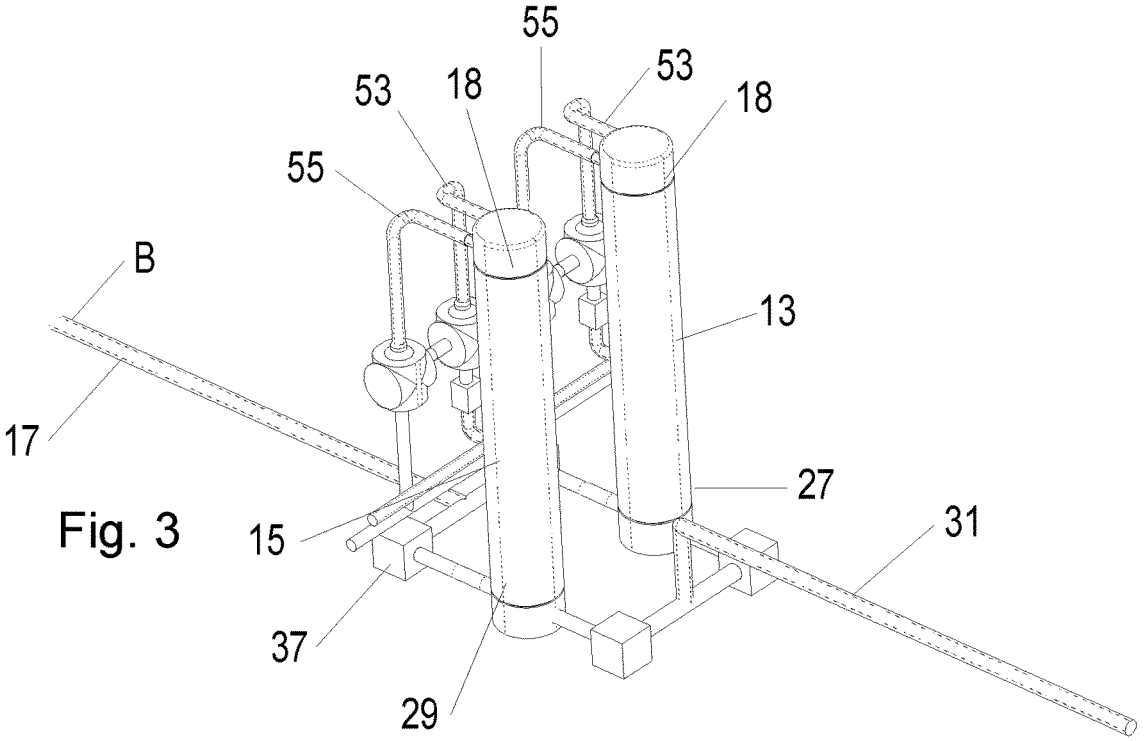
FIG. 3 is another perspective view of the assembly shown in FIG. 2.

The chambers 13 and 15 are preferably trailer mounted for easy portability between sites, as shown in FIG. 1. Each chamber 13, 15 has a lower inlet 19, 23 a lower outlet 21, 25 along the first or lower end 27, 29 of each chamber. The lower inlets 19, 23 and lower outlets 21, 25 are preferably 3 inches or greater in diameter to facilitate fluid transfer to be discussed in more detail and are preferably secured to the chambers 13 and 15 proximal to the cap ends 18 at the lower end 27, 29. The lower inlets 19 and 23 are fluidly connected to the blender B through a low pressure slurry line 17 and lower outlets 21, 25 are fluidly connected to the wellhead W through a high pressure slurry line 31. The lines are preferably at least 3 inch steel tubing and check valve members 33, 35, 37 and 39, being the type of standard valves and seats used on the suction and discharge of frac pumps, are preferably located inline on the lower inlets 19, 23 and lower outlets 21, 25 to regulate fluid flow to and from the chambers 13, 15. High pressure runs or lines are preferably used for the assembly with the exception of the low pressure slurry line 17 up to the check valve members 33 and 37 as well as low pressure fluid line 53, to be described in more detail. Other configuration of lines may be used without departing from the scope of the disclosure. The valves may be ball valves but sliding gate valves or sliding cylinders may also be used without departing from the scope of the disclosure.

Figure 5:
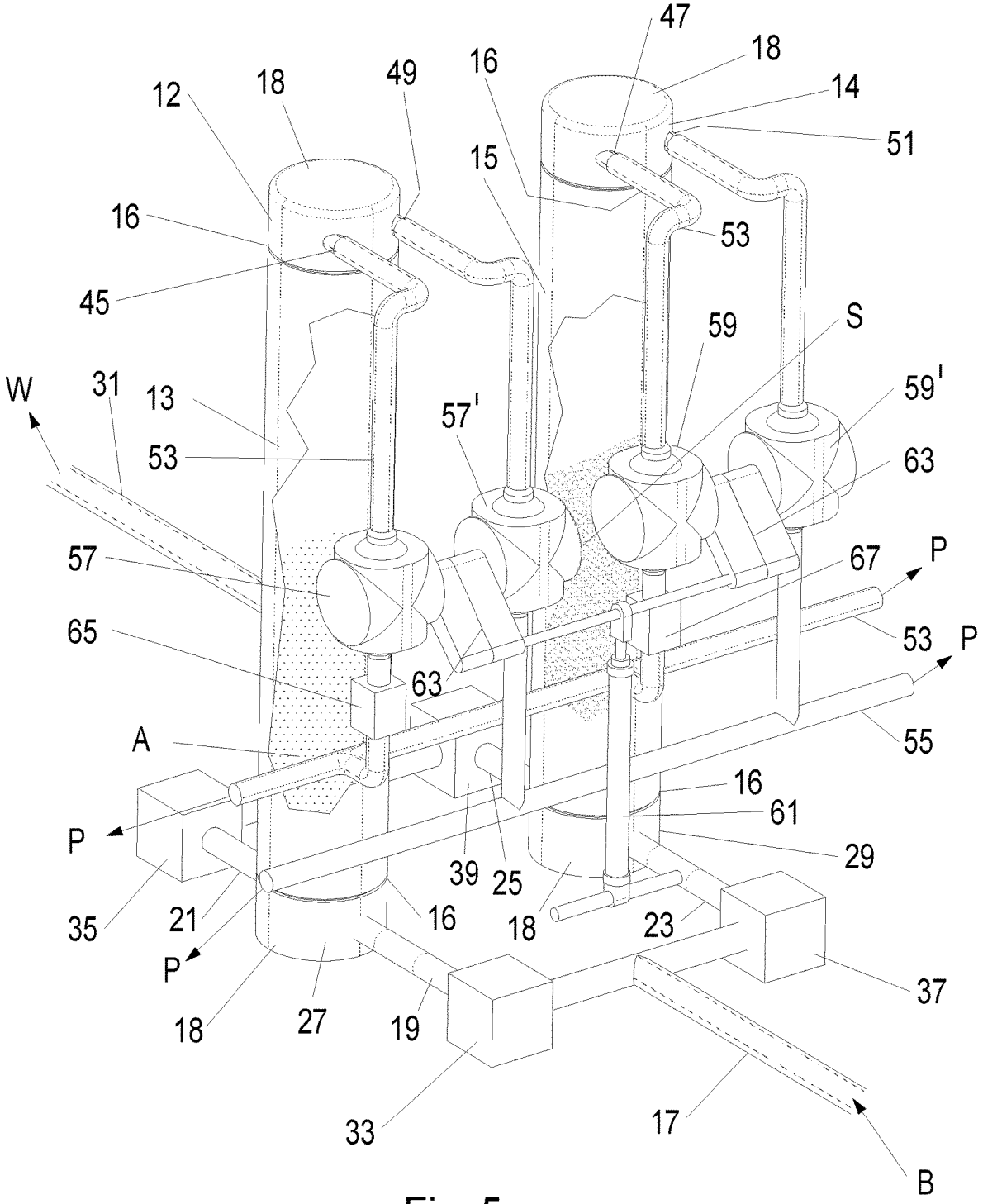
FIG. 5 is a perspective cut-away view of the assembly shown in FIG. 2.

The chambers 13 and 15 receive slurry S which is a mixture of sand A and clean fluid from the blender B through the low-pressure slurry line 17. Upper outlets 45, 47 and upper inlets 49, 51 of at least 3 inch or greater diameter are secured along second or upper ends 12, 14 of the chambers 13, 15, as shown in FIG. 5, and integrated with the cap ends 18 for fluid transfer. The upper outlets 45, 47 are fluidly connected to frac pumps P through the low-pressure clean fluid line 53. The low-pressure line 53 is connected to one or more pumps P, the chambers discharging fluid based upon synchronization by a logic control unit (not shown) that includes valve actuator 61 with actuator or control arms 63, 63'; flow meters 65 and 67 which are operatively connected to directional valves 57 and 59. Line 53 and the flowmeter will be exposed to the discharge pressure of the blender (between 50 and 120 psi). The upper inlets 49, 51 are fluidly connected to the frac pumps P through a high-pressure clean fluid line 55. The high-pressure line 55 is fluidly connected to a high-pressure discharge function of pump P and will be exposed to pressures of up to 15,000 psi and possibly higher with regulation by the valve actuator 61, the control arms 63, 63' and the directional valves 57', 59'. The directional valves 57, 57' and 59, 59' may be either rotating or sliding valves.

The logic control unit comprises a programmable logic controller that is well known in the art and is used in conjunction with the actuator 61 to control the valves. The connection is preferably a wireless connection but the unit may be wired without departing from the scope of the disclosure. The unit assembly includes the flow meters 65 and 67 to measure a flow of liquid through the valves 57, 59 and the actuator 61 includes a module that receives data from the flow meters, and determines, based on data received from the flow meters, the position of the valves. For example, the valve 57 will be in an open position while valve 57' will be in a closed position. In this manner, the volume of clean fluid removed from chamber 13 will be identical to the volume of pressurized fluid added to chamber 15. Once this cycle is complete, actuator 61 will reverse valves 57, 57', 59 and 59' allowing slurry S to enter chamber 15 displacing clean fluid to the frac pumps P for pressurization and pressurized fluid from the frac pumps will be transported to chamber 13 acting as a pressure plunger forcing the pressurized slurry into the wellhead. This pumping mechanism allows the clean fluid to recirculate from the top of the vessels into the frac pumps and back to the top of the adjacent vessel. As a result, the slurry is pressurized while preventing the sand laden fluid or slurry S from contacting the valves and seats of the frac pumps P. The pressurization of the slurry is accomplished by the frac pumps always injecting clean fluid into the top of either chamber preventing contact of the slurry with the frac pumps valves, seats and plungers. The chambers 13 and 15 are optimally operated in pairs for maximum efficiency on-site. Additional sets or pairs of chambers may be added to increase the volume of flow within a reduced period of time to the wellhead without departing from the scope of the disclosure.

In order for this system to work, it is imperative to be able to determine the exact volume of fluid in each chamber at all times. Having two identical chambers connected in the manner described herein greatly facilitates the measurement of the volume of fluid as the amount of slurry entering a given chamber is identical to the volume of clean fluid being pumped into the other chamber. This allows the exact determination of volumes present in each chamber by monitoring the low-pressure clean fluid exiting the valves 57, 59. This can be achieved through the use of flowmeters that will achieve a greater level of accuracy as they will always operate with low pressure clean fluid throughout the job.

In operation, clean fluid and sand are mixed in the blender B and the resulting slurry is delivered by the blender B to chamber 15 through the low-pressure slurry line 17 through check valve 33 and inlet 19. As the slurry is pumped in to chamber 15, the clean fluid is displaced through the outlet 47 and the low-pressure line 53. The directional valve 59 is set in open position so that the 'clean' fluid is discharged through the line 53, through flowmeter 67 and to the frac pumps P. The frac pumps P will energize the fluid to the necessary pressure, up to 15,000 psi, and it is then discharged through the high-pressure line 55 back to chamber 13 through synchronized valve 57 and the inlet 49.

Figure 6:
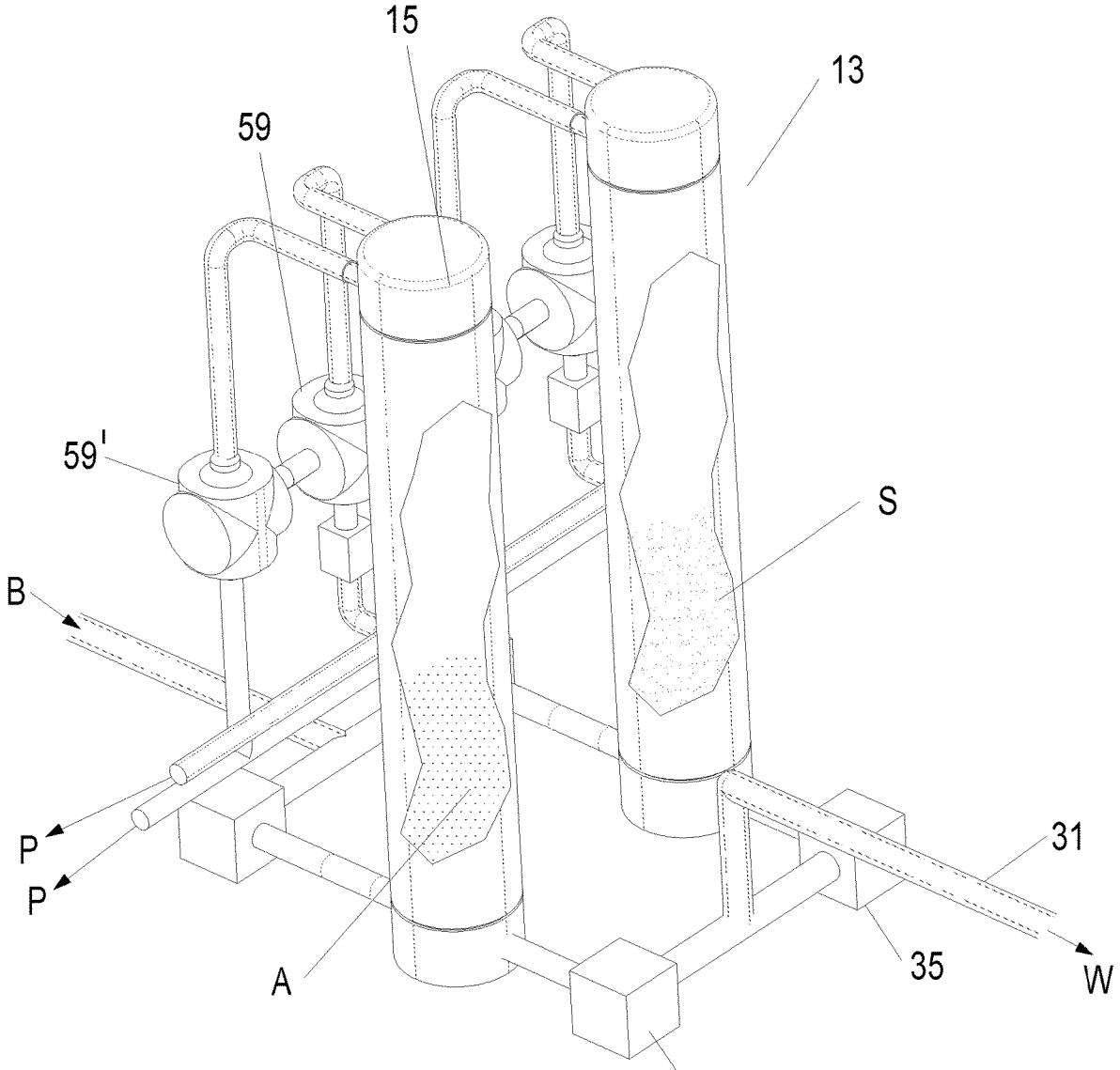
FIG. 6 is a perspective cut-away view of the assembly shown in FIG. 2.
Figure 7:
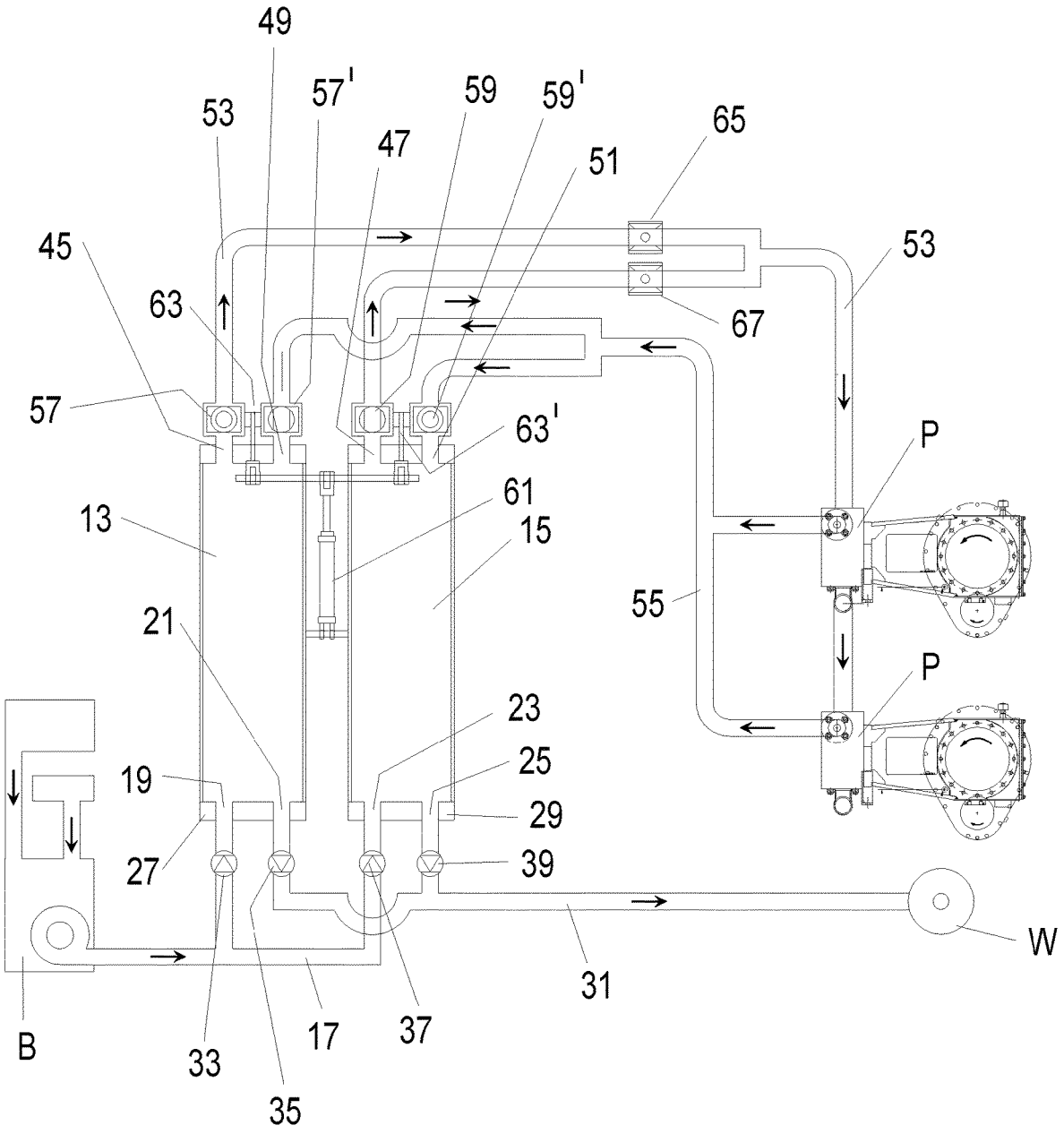
FIG. 7 is a schematic view of FIG. 2.

In further detail, referring to FIGS. 5, 6, and 7, clean fluid is delivered by the blender B to both chambers 13, 15 and then to the frac pumps P completely filling the system with clean fluid. After venting all high points, the frac pumps P will begin pumping and the flowmeters 65 or 67 will monitor the flow into the frac pumps. The logic control unit, in conjunction with the flowmeters 65 or 67 will monitor the volume of clean fluid coming out of each vessel. The frac pumps will energize the fluid to the necessary pressure and it is discharged to chamber 13 through the high-pressure clean fluid line forcing the fluid in chamber 13 into the wellhead W. When the blender begins to add sand into the fluid, the logic control unit will activate valves actuator 61 and begin monitoring the volume of fluid leaving chamber 15 through the flowmeter 67. As a result, the volume of clean water leaving the vessel is identical to the volume of slurry displacing it. Once a volume of clean water identical to the volume of the vessel has been registered by the flowmeter, the logic control unit will activate the valve actuator 61. The activation of the actuator 61 will simultaneously close the two open valves 57' and 59 and open the two previously closed valves 57 and 59'. This will cause the high-pressure clean fluid to flow into vessel 15, displacing the slurry into the wellhead. Simultaneously, vessel 13 will receive slurry from the blender B displacing clean fluid back to the frac pumps. This process will repeat again and again using the clean fluid of one chamber to pump the slurry in the other chamber to the wellhead, acting as a liquid plunger pump. Again, if additional pairs of chambers are added to the system, the process is repeated but with increased volume passing through the system.

As the slurry is pumped into the chambers, the vertical or incline position of the chambers gravitationally forces the sand to the lower portion 27, 29 of each of the chambers 13, 15. As sand falls to the lower end of the chamber 27 or 29, the fluid on the top of the chamber will be free of sand, further reducing the possibility of contaminating the clean fluid injected by the frac pumps. Further, the clean fluid used to displace the slurry from one vessel is provided to the frac pump by the blender pumping slurry into the other vessel and displacing the clean fluid back into the frac pumps' suction. This prevents sand from reaching the frac pump valves, seats and fluid ends. This is further assisted by the vertical position of the vessels as gravity assist on keeping the sand away from the clean fluid. By displacing slurry into the well with the clean fluid coming from the adjacent vessel, a closed loop is created ensuring that the volume displaced into one vessel is identical to the volume pumped from the other vessel. The displacement of slurry with the clean fluid as it exits the vessel is controlled by the usage of low-pressure flowmeters.

Finally, as high-pressure clean fluid enters the top of a cylinder where the sand has accumulated at the bottom, even if it has achieved maximum concentration of 22.1 lbs./gals., the clean fluid will displace the slurry towards the wellhead as frac sand will always be permeable. The difference in pressure, if any, between the well pressure and the pressure required to open the discharge check valve of the cylinder will be proportional to the permeability of the sand being pumped into the well. This will provide a quality control of the sand being utilized. The clean fluid used in the system can also be of a different viscosity and composition if it is necessary to further separate the fluids.

For example, assuming that manufacturing the chambers from commercially available HHS tube of 20 in. diameter with 1.417 wall thickness and 100.1 inches in height, this system will pump 2.41 bbl./stroke. Introducing an 18 lbs./gal slurry it will require 1,000 strokes to pump 2,410 bbl. carrying 1,000,000 lbs. of sand or 1,000 lbs./stroke. To deliver the same amount of slurry by a standard plunger pump will require 185,295 strokes for a 4-inch diam plunger and 10-inch stroke pump and 231,619 strokes for a 4-inch diam plunger and 8-inch stroke pump. However, most frac jobs pump a much lower density slurry. Pumping a 3 lbs./gal. slurry it will take 9,014 bbl. of slurry to carry a 1,000,000 lbs. of sand requiring 613,404 strokes for the 10-inch stroke pump and 766,754 strokes for the 8 inches.

Figure 8:
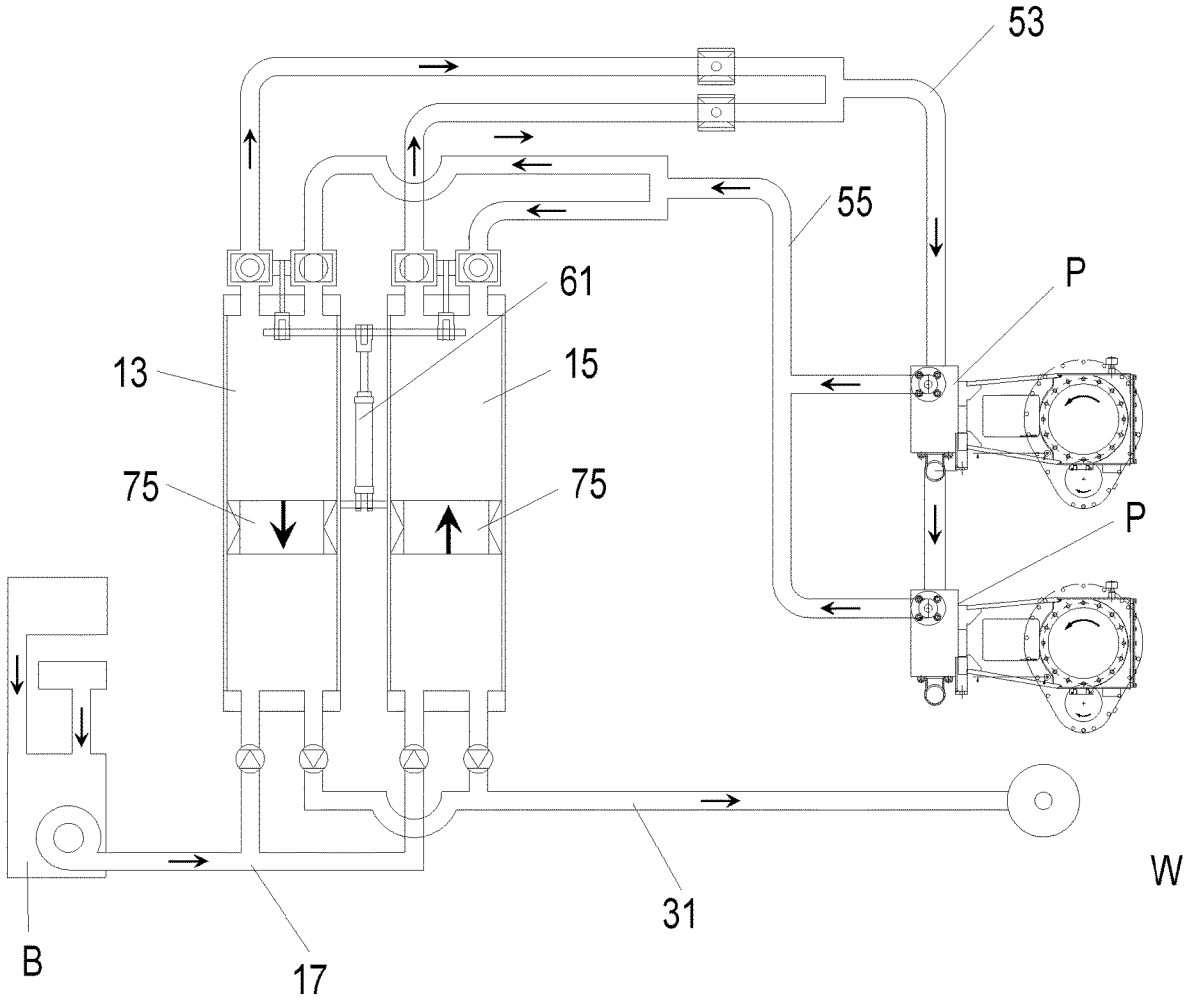
FIG. 8 is a schematic view of an alternate form of the assembly.
Figure 9:
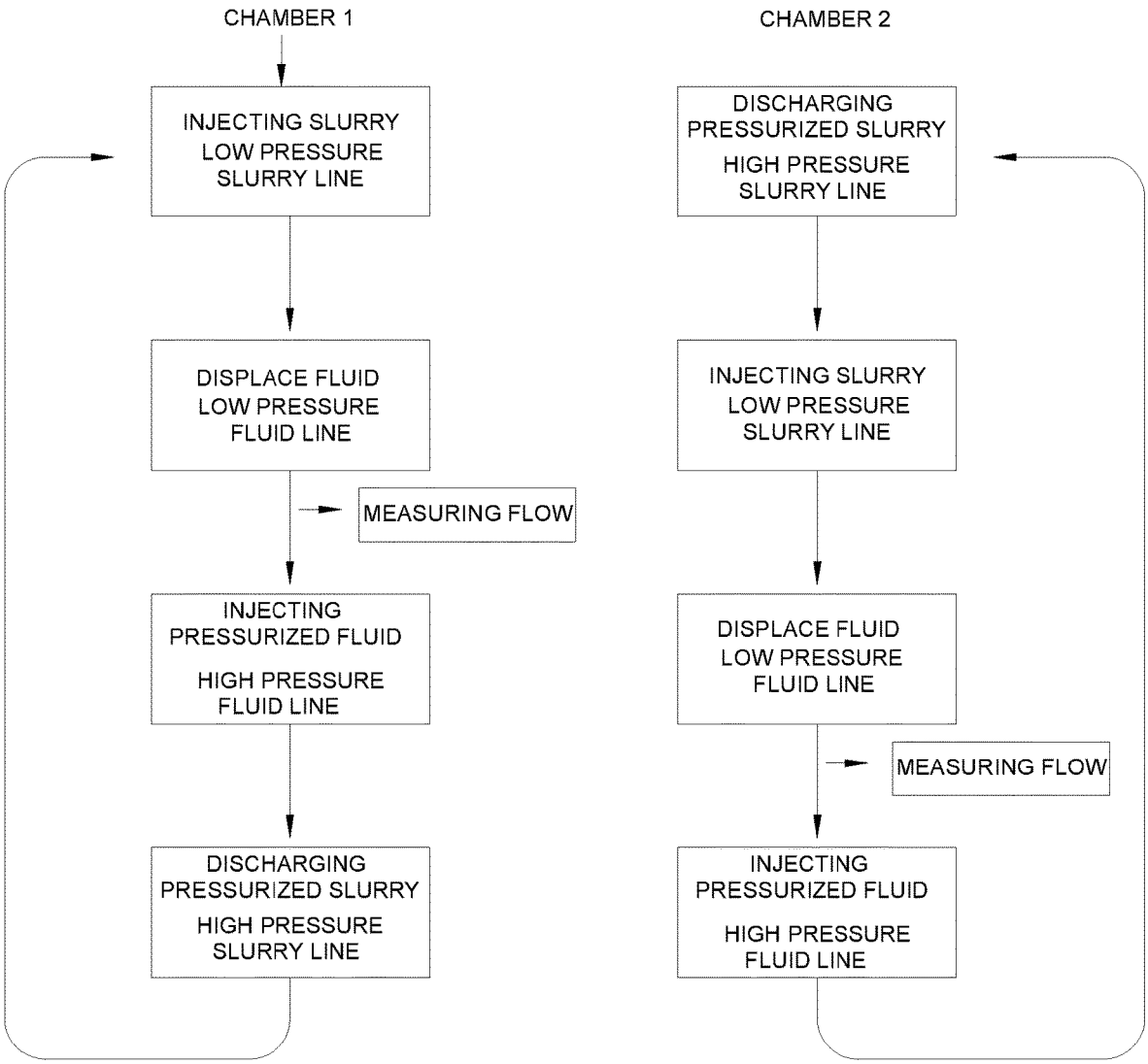
FIG. 9 is a block diagram of the method.

A second form of assembly is shown in FIG. 8 with like parts correspondingly enumerated. If it is desired to have a clear separation of fluid and sand, a free-floating mechanical plunger 75 may be incorporated into the chambers 13 and 15. Internal machining of the chambers 13 and 15 will be required in order to obtain a seal insuring separation of the clean fluid from the sand. This may be used when pumping highly contaminated, dangerous or radioactive fluids.

It is therefore to be understood that while different embodiments have been herein set forth and described, various modifications and changes may be made therein without departing from the spirit and scope of the present invention as defined by the appended claims.

I claim:

1. An apparatus for pressurizing and intermixing sand and fluid using a blender and frac pumps for discharge into a wellhead, comprising:

at least one pair of plunger pump chambers, each of first and second chambers adapted for vertical or semi-vertical orientation on a vertical axis;

at least one inlet line secured at a first lower end of each of said first chamber and said second chamber and in fluid communication with said blender;

at least one high pressure outlet line oriented opposite said at least one inlet line and secured at said first lower end of each of said first chamber and said second chamber and in fluid communication with said wellhead;

at least one outlet line secured to a second upper end of each said first chamber and said second chamber and to said frac pumps;

at least one high pressure inlet line secured to said second upper end of each of said first and said second chamber and to said frac pumps;

said outlet and said inlet lines secured to said second upper ends recirculating clean fluid between said chambers and said frac pumps;

first check valve members operatively connected to each of said inlet lines and said high pressure outlet lines proximal to said first lower end of each of said first chamber and said second chamber;

second directional valve members operatively connected to each of said outlet lines and said high pressure inlet lines proximal to said second upper end of each of said first chamber and said second chamber; and flow meters mechanically connected to each of said second directional valve members connected to each of said outlet lines and operatively connected to a logic control unit including at least one valve actuator and at least one control arm.

2. The apparatus according to claim 1 wherein said first and second chambers include elongated chamber walls and cap ends secured to opposite ends of each of said first and second chambers.

3. The apparatus according to claim 1 wherein said flow meters are located proximal to said second valve members on said outlet lines.

4. The apparatus according to claim 1 wherein said logic control unit is adapted to control said first and second valve members.

5. The apparatus according to claim 1 wherein said first valve members comprise ball valves.

6. The apparatus according to claim 1 wherein said second valve members comprise sliding valves.

7. The apparatus according to claim 1 wherein said at least two inlet lines include a combination of a low-pressure line and a high-pressure line.

8. The apparatus according to claim 1 wherein said at least two outlet lines include a combination of a low-pressure line and a high-pressure line.

9. The apparatus according to claim 1 wherein said frac pumps provide pressurization to said fluid in said high-pressure inlet lines.

10. The apparatus according to claim 1 wherein said pressurized fluid forces sand and fluid into said high-pressure outlet lines.

11. The apparatus according to claim 1 wherein each of said first and second chambers includes a mechanical plunger.

12. An apparatus for injecting pressurized slurry into a wellhead, the apparatus having a blender unit and at least one fracturing pump, the apparatus comprising:

dual elongated vertically or semi-vertically oriented chambers having upper and lower cap ends sealing each of said chambers;

at least one outlet and at least one high-pressure inlet proximal to an upper end of each of said chambers;

at least one inlet and at least one-high pressure outlet proximal to a lower end of each of said chambers;

each of said upper end inlets and outlets recirculating clean fluid between said chambers and said at least one fracturing pump;

each of said upper end inlets and outlets having corresponding directional valve members and each of said lower end inlets and outlets having corresponding check valve members;

each of said upper end outlets having a mechanically connected flow meter proximal to said valve members;

each of said directional valve members having a corresponding actuator with valve actuator arms; and a logic control unit operatively connected to each of said actuators, said directional valve members and said valve actuator arms.

13. The system according to claim 12 wherein said chambers include a free-floating plunger.

14. A method of pressurizing and discharging slurry into a wellhead, the steps comprising:

filling a first vertical or semi-vertical chamber, a second vertical or semi-vertical chamber and frac pumps with clean fluid;

injecting slurry into a lower portion of said first chamber through a check valve and displacing clean fluid from said first chamber into one of said frac pumps through a first directional valve;

measuring the flow of displaced clean fluid from said first chamber into one of said frac pumps with a first flow meter;

injecting pressurized fluid from one of said frac pumps through a second directional valve into said second chamber and displacing contents from a lower portion of said second chamber into the wellhead;

reversing said directional valves thereby injecting slurry into said second chamber and displacing clean fluid from said second chamber into one of said frac pumps;

measuring the flow of displaced clean fluid from said second chamber into one of said frac pumps with a second flow meter; and wherein each of said directional valves are operatively connected to at least one valve actuator and at least one control arm.

15. The method according to claim 14 wherein said steps further include simultaneously injecting slurry into said first chamber whereby clean fluid is displaced into said frac pumps and injecting pressurized clean fluid into said second chamber thereby displacing contents of said second chamber into the wellhead.

16. The method according to claim 14 wherein said step of reversing directional valves includes simultaneously injecting slurry into said second chamber displacing clean fluid into said frac pumps and injecting pressurized clean fluid into said first chamber thereby displacing contents of said first chamber into the wellhead.

17. The method according to claim 14 whereby said steps are synchronized with a logic control unit, actuating valves and flow meters.

18. The method according to claim 14 wherein the steps further include blending liquids and solid particles by counterflow of the liquids to prevent contact with said pump.

19. A method for pressurizing slurry, having a blender and at least one frac pump, the steps comprising:

intermixing fluid and sand within said blender forming a slurry;

injecting low-pressure slurry into a lower portion of a vertically or semi-vertically oriented first chamber and discharging pressurized slurry from a lower portion of a vertically or semi-vertically oriented second chamber into a wellhead through a first check valve;

displacing clean fluid from said first chamber and injecting low-pressure slurry into said second chamber through a second check valve;

measuring clean fluid flow from said first chamber and said second chamber to said at least one frac pump with at least one flow meter and recording said fluid flow measurement on a logic control unit;

actuating four directional valve members based upon said fluid flow measurement wherein each of said chambers are mechanically connected to at the least four directional valve members;

injecting pressurized clean fluid into said first chamber;

recirculating clean fluid between said chambers and said at least one frac pump;

discharging pressurized slurry from said first chamber into a wellhead and injecting pressurized clean fluid into said second chamber; and wherein each of said directional valves are operatively connected to at least one valve actuator and at least one control arm.

20. The method according to claim 19 wherein said steps are repeated after each cycle.

21. The method according to claim 19 wherein the steps further include calibration of flow through said first and second chambers with said at least one flow meter.

22. The method according to claim 19 wherein the steps include incorporating a mechanical plunger within each one of said first and second chambers.

* * * * *